US010034090B2

(12) United States Patent
Maeda et al.

(10) Patent No.: US 10,034,090 B2
(45) Date of Patent: Jul. 24, 2018

(54) AUDIO CONTROL DEVICE

(71) Applicant: ALPINE ELECTRONICS, INC., Shinagawa-ku, Tokyo (JP)

(72) Inventors: Yoshikazu Maeda, Fukushima (JP); Minoru Matsuyama, Fukushima (JP); Masashi Saito, Fukushima (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 15/646,848

(22) Filed: Jul. 11, 2017

(65) Prior Publication Data

US 2018/0063639 A1 Mar. 1, 2018

(30) Foreign Application Priority Data

Aug. 24, 2016 (JP) ..... 2016-163320

(51) Int. Cl.
*G10L 21/0208* (2013.01)
*H04R 3/08* (2006.01)
*H04R 9/02* (2006.01)

(52) U.S. Cl.
CPC ..... *H04R 3/08* (2013.01); *H04R 9/022* (2013.01)

(58) Field of Classification Search
CPC ..... H04R 3/00; H04R 3/02; H04R 2201/029
USPC ..... 381/104–108, 94.1–94.3
See application file for complete search history.

(56) References Cited

U.S. PATENT DOCUMENTS 5,170,437 A * 12/1992 Strahm ..... H03G 3/3005 381/102

FOREIGN PATENT DOCUMENTS

JP 2009-065427 3/2009

* cited by examiner

*Primary Examiner* — George C Monikang
(74) *Attorney, Agent, or Firm* — Brinks Gilson & Lione

(57) ABSTRACT

A first fixed filter extracts high-frequency and low-frequency sound signals outside the audible band, and a level integrator integrates levels of the sound signals to obtain a first integrated value. With a second fixed filter, the level integrator integrates levels of sound signals in a low frequency band within the audible band to obtain a second integrated value. A control unit determines whether the high-frequency sound signals are dominant by comparing the first integrated value with the second integrated value. When the high-frequency sound signals are dominant, the control unit attenuates high-frequency speaker drive signals using a variable filter.

18 Claims, 3 Drawing Sheets

AUDIO CONTROL DEVICE

RELATED APPLICATION

The present application claims priority to Japanese Patent Application Number 2016-163320, filed Aug. 24, 2016, the entirety of which is hereby incorporated by reference.

BACKGROUND

1. Field of the Invention

The present invention relates to an audio control device that performs control to constantly provide a speaker with an optimum speaker drive signal.

2. Description of the Related Art

When direct current flows through a voice coil of a speaker, there may be a case where the voice coil does not vibrate, an air cooling effect is not exhibited, heat accumulates to raise the temperature, and the voice coil is damaged. For this reason, a large number of techniques have been conventionally proposed to address the situation in which direct current does not flow through the voice coil. In addition, a large number of techniques have been proposed with which to limit the output in a case where a large amount of heat is expected to accumulate in spite of employing alternating current with which the air cooling effect is exhibited. Incidentally, a super high-frequency component exceeding the human audible band is considered to originally have a small amount of energy, and thus countermeasures against such component are not particularly considered in many cases. However, as in JP 2009-65427 A, techniques taking into account countermeasures against a super high-frequency component have also been proposed.

In JP 2009-65427 A, it is considered that an output transistor and a voice coil of a speaker may be destroyed when input signals of the super high-frequency component applied to the speaker become excessive. Therefore, a conventional audio power amplifier includes a low-pass filter that allows only an input signal in the audible band to pass therethrough for safety, and attenuates an input signal of 20 kHz or higher, which is a super high-frequency component higher than the audible band.

Recently, however, music sources that have recorded components in a higher frequency range than the audible band have been increasing, and super high-frequency input signals of such music sources have been increasingly input to speakers.

Therefore, JP 2009-65427 A discloses an invention relating to an acoustic signal power amplifier, which is capable of inputting an input signal having a super high-frequency component exceeding the audible band by removing the low-pass filter in order to handle the music source.

This acoustic signal power amplifier is provided with a high-pass filter section that extracts a super high-frequency component from among the frequency components of an input signal. An output signal from the high-pass filter section is input to a level control unit, in which the gain is adjusted such that the level of the super high-frequency component does not exceed a predetermined value.

The acoustic signal power amplifier described in JP 2009-65427 A limits the level of a super high-frequency component when that level is high. However, there is the following problem with a super high-frequency range exceeding a frequency that the voice coil can follow and vibrate. That is, in such a range, the voice coil stops and the air cooling effect is not exhibited, and thus heat accumulates even if the level of the super high-frequency component is not particularly high, leading to the breakdown of the voice coil. There is another problem in that, although heat is not accumulated in the voice coil and there is no possibility of breakdown, the level of the super high-frequency component is limited and the acoustic effect is lowered.

SUMMARY

The present disclosure has been made to solve the above-mentioned conventional problems, and an object of the present disclosure is to provide an audio control device that can enhance the acoustic effect by using, as much as possible, sound signals in a higher frequency range than the audible band as speaker drive signals, and reliably prevent overheating and breakdown of the speaker.

In the present disclosure, unlike the related art, the low-pass filter does not cut an input signal in a higher frequency range than the audible band but outputs the input signal directly to a speaker without attenuating a super high-frequency component of the signal, and the level of the super high-frequency component is limited when that level is high.

The present disclosure describes an audio control device that generates a speaker drive signal by processing a sound signal from a sound source input unit, and the audio control device includes:

a first fixed filter that allows a sound signal in a frequency band higher than a first frequency to pass therethrough; a level integrator that obtains a first integrated value by integrating levels of sound signals that have passed through the first fixed filter; and a control unit, wherein the control unit limits a sound signal in a frequency band higher than at least the first frequency when the first integrated value exceeds a predetermined value.

In the audio control device according to an embodiment of the present invention, preferably, a sound signal in a frequency band lower than a second frequency (the second frequency<the first frequency) is allowed to pass through the first fixed filter or another fixed filter connected to the first fixed filter, and the level integrator obtains the first integrated value by integrating the levels of sound signals in a frequency band higher than the first frequency and the levels of sound signals in a frequency band lower than the second frequency.

More preferably, the audio control device according to an embodiment of the present invention further includes a second fixed filter that allows a sound signal in a low frequency band defined in a predetermined range within a frequency band lower than the first frequency to pass therethrough, wherein the level integrator obtains a second integrated value by integrating levels of sound signals in the low frequency band, and the control unit avoids limiting a frequency band higher than the first frequency among the speaker drive signals when the second integrated value is larger than the first integrated value.

Further preferably, the audio control device according to an embodiment of the present invention further includes a second fixed filter that allows a sound signal in a low frequency band defined in a predetermined range within a frequency band lower than the first frequency but higher than the second frequency to pass therethrough, wherein the level integrator obtains a second integrated value by integrating levels of sound signals in the low frequency band, and the control unit avoids limiting a frequency band higher than the first frequency among the speaker drive signals when the second integrated value is larger than the first integrated value.

For example, in the audio control device according to an embodiment of the present invention, the control unit limits a frequency band higher than at least the first frequency when the first integrated value exceeds a predetermined value and the second integrated value is lower than a predetermined value.

The audio control device according to an embodiment of the present invention further includes a frequency varying unit that varies a frequency distribution of the speaker drive signals, wherein the control unit controls the frequency varying unit to limit a frequency band higher than the first frequency among the speaker drive signals.

In the audio control device according to an embodiment of the present invention, the first frequency is set to any value within a range of 18 to 28 kHz. In addition, the second frequency is set to any value within a range of 5 to 50 Hz. Furthermore, the low frequency band is defined within a range of 20 Hz to 500 Hz.

In the audio control device according to an embodiment of the present invention, the control unit may perform tone adjustment using an integrated value from the level integrator.

The audio control device according to an embodiment of the present invention obtains the first integrated value by integrating the levels of sound signals in a frequency band higher than the first frequency using the level integrator. When the first integrated value exceeds a predetermined value, the audio control device limits the frequency band higher than the first frequency among the speaker drive signals. Even if the level of the signal in a higher frequency range than the first frequency is high, the signal can be applied to the speaker as long as the first integrated value does not exceed the predetermined value; therefore, a high acoustic effect can be maintained. In addition, even if the level of the signal in a higher frequency range than the first frequency is low, the frequency band higher than the first frequency is limited in a case where the first integrated value exceeds the predetermined value; therefore, the overheating and breakdown of the speaker can be reliably prevented.

Furthermore, by providing the second fixed filter, sound signals in a low frequency band can be extracted and a second integrated value obtained by integrating the levels of the signals in the low frequency band can be taken into account, whereby the acoustic effect can be maintained. If the second integrated value is large and the level of the sound signal in the low frequency band is high, the amplitude of the voice coil is large and the cooling effect becomes high, and the temperature rise is suppressed. In such a case, it is possible not to limit the level of a signal in a high frequency range, and even if the first integrated value increases due to the high level of the sound signal in the high frequency range, the sound signal in the higher frequency range than the first frequency can be used at a high level, making it possible to further enhance the acoustic effect.

DETAILED DESCRIPTION OF THE PREFERRED EMBODIMENTS

Figure 1:
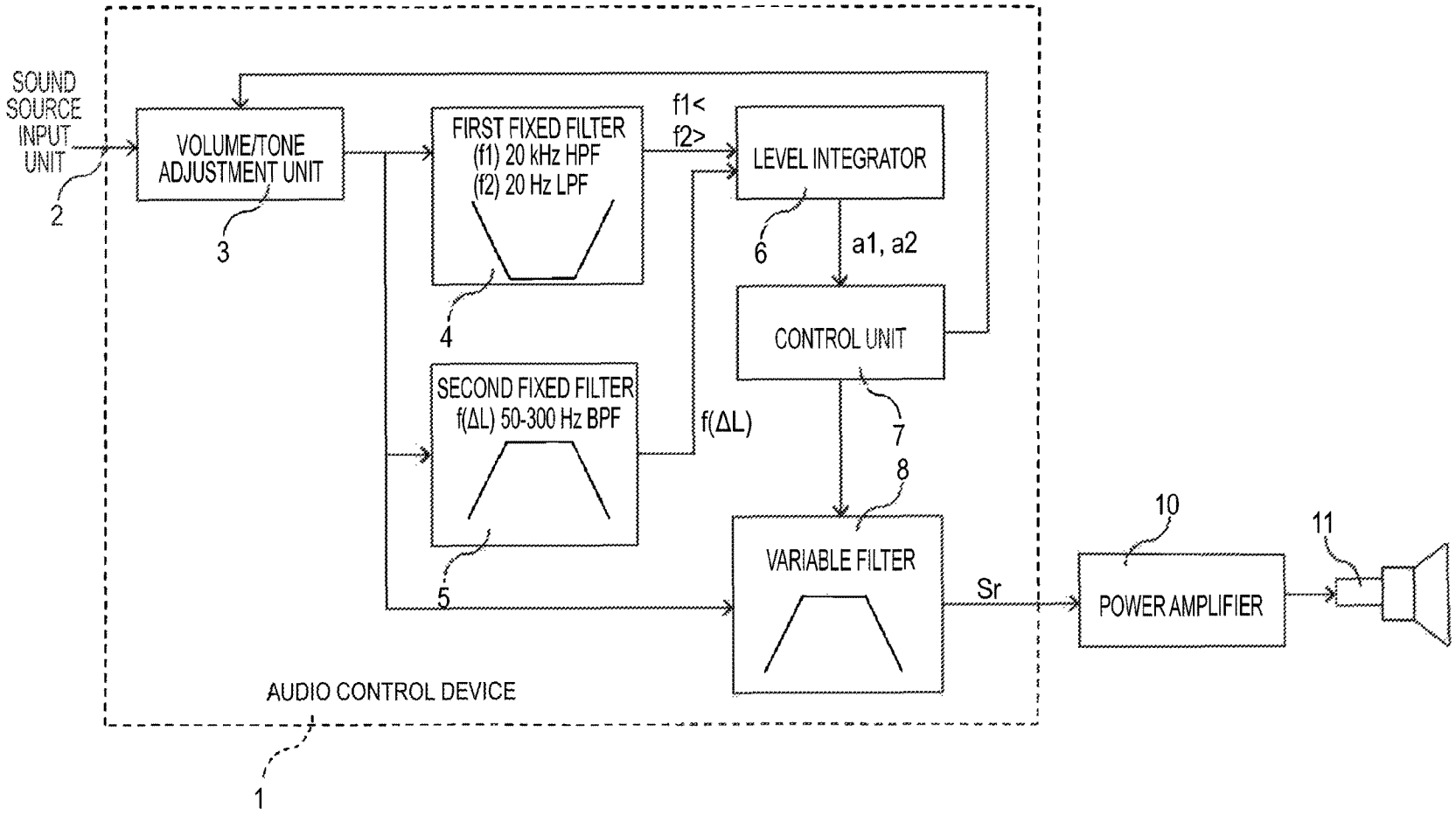
FIG. 1 is a block diagram of an audio control device according to an embodiment of the present invention.

FIG. 1 is a block diagram of an audio control device 1 according to an embodiment of the present invention.

The audio control device 1 includes a sound source input unit 2. A sound signal input from the sound source input unit 2 is applied to a volume/tone adjustment unit 3. In the volume/tone adjustment unit 3, the volume and reproduction tone can be manually adjusted via an operation unit (not shown), but the adjustment operation is also performed using a control signal from a control unit 7 to be described later.

The sound signal adjusted by the volume/tone adjustment unit 3 is applied to a first fixed filter 4 and a second fixed filter 5. The first fixed filter 4 allows a sound signal in a higher frequency range than a first frequency f1 and a sound signal in a frequency range lower than a second frequency f2 to pass therethrough, and attenuates or blocks a sound signal in a frequency band between the first frequency f1 and the second frequency f2.

The first fixed filter 4 allows a sound signal outside the human audible band to pass therethrough. The first frequency f1 is set to any value in the range of 18 to 28 kHz, which is a value close to the upper limit frequency of the audible band. Preferably, the first frequency f1 is set to any value in the range of 18 to 22 kHz. In the first fixed filter 4 of the embodiment shown in FIG. 1, the first frequency f1 is set to 20 kHz.

The second frequency f2 is set to any value in the range of 5 to 50 Hz, which is a value close to the lower limit frequency of the audible band. Preferably, the second frequency f2 is set to any value in the range of 10 to 30 Hz. In the first fixed filter 4 of the embodiment shown in FIG. 1, the second frequency f2 is set to 20 Hz.

The first fixed filter 4 is configured as one element obtained by combining a high-pass filter (HPF) having a cutoff frequency at 20 kHz that is the first frequency f1 and a low-pass filter (LPF) having a cutoff frequency at 20 Hz that is the second frequency f2. Alternatively, a high-pass filter (HPF) and a low-pass filter (LPF) configured as separate elements may be combined and used.

The second fixed filter 5 is a band-pass filter (BPF) that allows a sound signal in a relatively low frequency band f (L1 to L2) that is lower than the first frequency f1 (20 kHz) but higher than the second frequency f2 (20 Hz) to pass therethrough. The low frequency band f (L1 to L2) selected herein is set to a range in which the amplitude of the voice coil becomes large and the cooling effect for the voice coil can be expected when the speaker is driven. The low frequency band f (L1 to L2) is a frequency band defined in the range of 20 Hz to 500 Hz. The second fixed filter 5 shown in FIG. 1 allows a sound signal in the low frequency band f (L1 to L2) of 50 Hz to 300 Hz to pass therethrough.

The sound signal that has passed through the first fixed filter 4 and the sound signal that has passed through the second fixed filter 5 are applied to a level integrator 6. The level integrator 6 obtains a value by integrating the level (intensity) of the sound signal with time. The level of the sound signal that has passed through the first fixed filter 4 and has a super high frequency equal to or higher than the first frequency f1 (20 kHz) is integrated for a predetermined time, and the level of the sound signal that has passed through the first fixed filter 4 and has a super low frequency equal to or lower than the second frequency f2 (20 Hz) is also integrated for a predetermined time. The sum of the integrated value of the levels of the sound signals exceeding the first frequency f1 and the integrated value of the levels of the sound signals lower than the second frequency f2 is a first integrated value a1.

The sound signal of the low frequency band f (L1 to L2) (50 Hz to 300 Hz or less) that has passed through the second fixed filter 5 is also sent to the level integrator 6, and the signal level is integrated for the time period equal to that of integration applied to the signal that has passed through the first fixed filter 4, whereby a second integrated value a2 is obtained. Then, the first integrated value a1 and the second integrated value a2 are sent to the control unit 7.

Based on the first integrated value a1 and the second integrated value a2, the control unit 7 controls the cutoff frequency of a variable filter 8, which is a frequency varying unit, or controls on/off of the variable filter 8. The control unit 7 can also adjust the volume/tone adjustment unit 3 based on the first integrated value a1 and the second integrated value a2.

Among the sound signals adjusted by the volume/tone adjustment unit 3, the signal of a frequency band that has passed through the variable filter 8 is applied to a power amplifier 10 and to the voice coil of a speaker 11 as a speaker drive signal Sr, whereby the speaker 11 is driven.

Next, the operation of the audio control device 1 will be described.

Figure 3A:
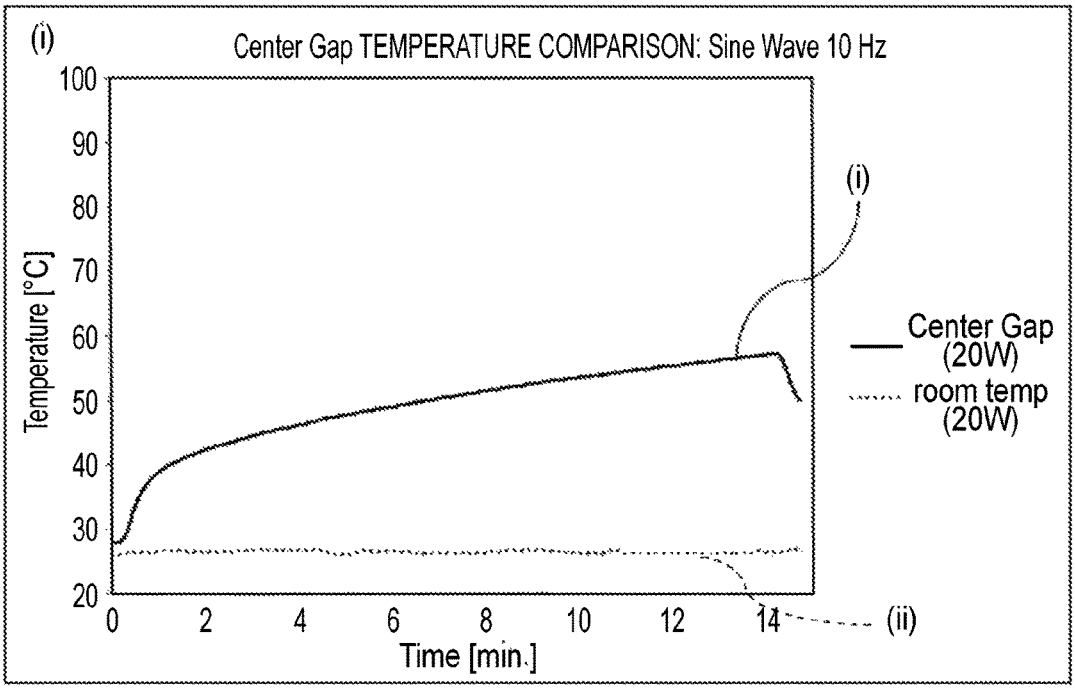
FIGS. 3A and 3B are graphs showing a relationship between the frequency of a speaker drive signal applied to a voice coil of a speaker and a coil temperature.
Figure 3B:
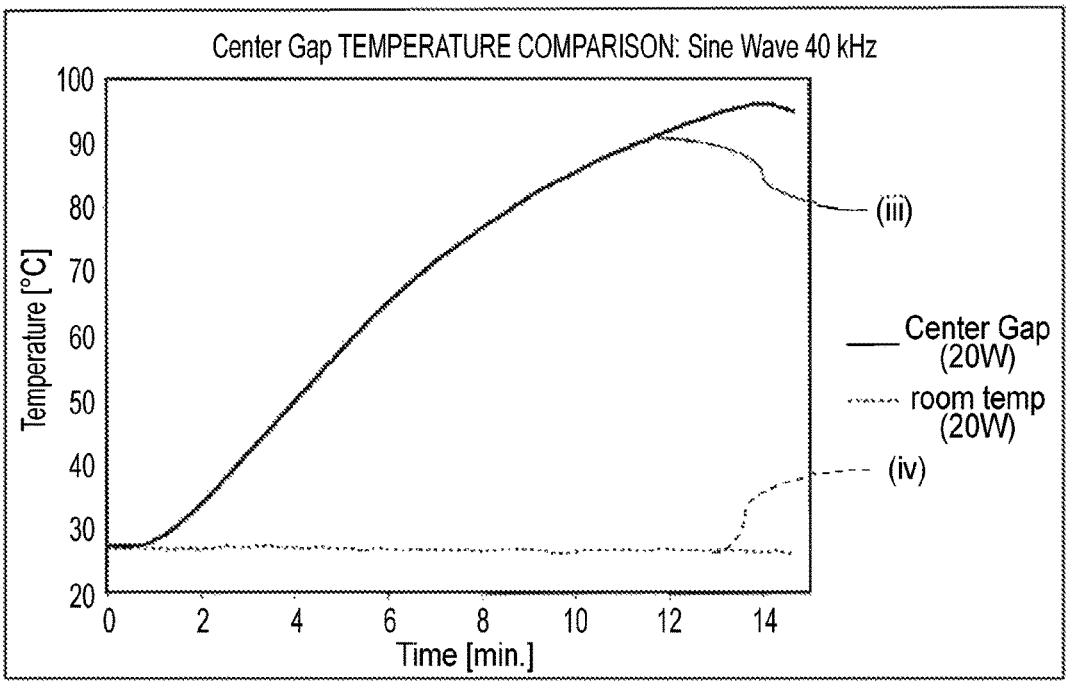

FIG. 3A shows a change in the temperature of the voice coil when a speaker drive signal of 10 Hz, which is a super low frequency lower than the audible band and close to direct current, is applied to the speaker. FIG. 3B shows a change in the temperature of the voice coil when a speaker drive signal of 40 kHz, which is a super high frequency exceeding the audible band, is applied to the speaker. In either case, the horizontal axis represents the passage of time (minutes), and the vertical axis represents the temperature of the voice coil. In FIGS. 3A and 3B, the temperature rise is measured using a two-way speaker having a cone (diaphragm) diameter of 17 cm.

FIG. 3A shows, with a line (i), a change in the temperature of the voice coil when a sinusoidal wave of a single frequency of 10 Hz is applied to the voice coil as a speaker drive signal and the speaker is driven at 20 W, and a change in the ambient temperature (room temperature) at that time is indicated by (ii).

FIG. 3B shows, with a line (iii), a change in the temperature of the voice coil when a sinusoidal wave of a single frequency of 40 kHz is applied to the voice coil as a speaker drive signal and the speaker is driven at 20 W, and a change in the ambient temperature at that time is indicated by (iv).

According to the result of FIG. 3A, when a speaker drive signal of a super low frequency lower than approximately 20 Hz that is the lower limit of the audible band is applied to the speaker, the temperature of the voice coil rises about 30° C. in 14 minutes. According to the result of FIG. 3B, when a speaker drive signal of a super high frequency exceeding approximately 20 kHz that is the upper limit of the audible band is applied to the speaker, the temperature of the voice coil rises about 70° C. in 14 minutes.

When the speaker drive signal of an extremely low frequency or the speaker drive signal of an extremely high frequency outside the audible band as described above is applied to the voice coil of the speaker 11, the voice coil hardly moves and the air around the voice coil is not stirred. In this case, therefore, it is difficult to sufficiently dissipate heat generated by the voice coil into the surrounding space. Therefore, there is a high risk of the voice coil tending to be excessively heated and damaged.

Therefore, the first fixed filter 4 extracts a sound signal having a frequency equal to or higher than 20 kHz that is the first frequency f1 and a sound signal having a frequency equal to or lower than 20 Hz that is the second frequency f2, and the level integrator 6 calculates the first integrated value a1 by adding the integrated value of the levels of the sound signals exceeding 20 kHz and the integrated value of the levels of the sound signals of 20 Hz or less. When it is determined that the first integrated value a1 is too high, the control unit 7 controls the variable filter 8 to make it possible to suppress the application of a super high-frequency speaker drive signal to the voice coil.

Meanwhile, the frequency of a sound signal of 50 Hz to 300 Hz extracted by the second fixed filter 5 is within the audible band. When a sound signal of the low frequency band f (L1 to L2) is applied to the voice coil of the speaker 11, the voice coil vibrates with a considerably large amplitude. As a result, the air around the voice coil is stirred, heat generated in the voice coil is easily released into the air, and thus the cooling effect is enhanced.

Therefore, the control unit 7 performs calculations based on the first integrated value a1 of the levels of the sound signals that have passed through the first fixed filter 4 and the second integrated value a2 of the levels of the sound signals that have passed through the second fixed filter 5, and variably controls the pass band of the variable filter 8 that is a frequency varying unit.

Figure 2:
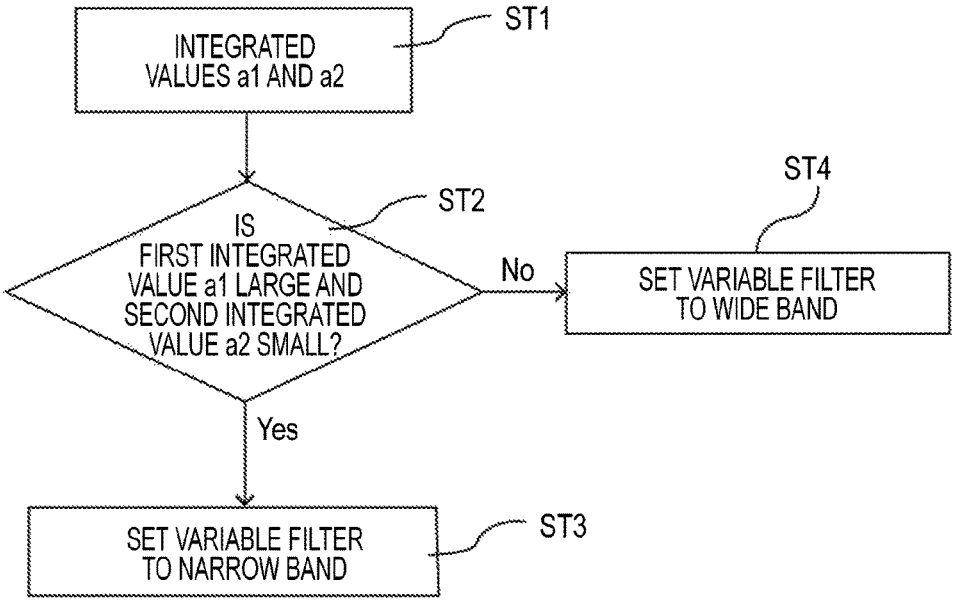
FIG. 2 is a flowchart showing an example of a control operation in a control unit shown in FIG. 1.

FIG. 2 is a flowchart of the processing operation in the control unit 7. The control unit 7 mainly includes a CPU and a memory.

In step 1 (ST1) shown in FIG. 2, when the first integrated value a1 and the second integrated value a2 are given to the control unit 7, the control unit 7 determines whether the first integrated value a1 is large while taking into account the magnitude of the second integrated value a2, and determines whether to change the passing frequency of the variable filter 8.

When it is determined in ST2 that the first integrated value a1 is equal to or larger than a first threshold value and the second integrated value a2 is equal to or less than a second threshold value, the process proceeds to ST3, in which the passing frequency band of the variable filter 8 is changed to a narrow band. If the condition that the first integrated value a1 exceeds the first threshold value and the second integrated value a2 is not more than the second threshold value is not satisfied in ST2, the process proceeds to ST4, in which the passing frequency band of the variable filter 8 is changed to a wide band.

That is, even if the first integrated value a1 obtained by integrating the levels of the sound signals exceeding the first frequency f1 and the sound signals equal to or lower than the second frequency f2 is high, as long as the second integrated value a2 obtained by integrating the levels of the sound signals of the low frequency band f (L1 to L2) is high, the dominant rate of the sound signals of 50 to 300 Hz exceeds a predetermined rate and it becomes possible to exhibit a sufficient cooling effect on the voice coil. In this case, even if the variable filter 8 is set to a wide band and a speaker drive signal of a high frequency band exceeding 20 kHz is applied to the voice coil, the risk of the voice coil being damaged by excessive heat can be reduced.

Meanwhile, when the first integrated value a1 obtained by integrating the levels of the sound signals exceeding the first frequency f1 and the sound signals equal to or lower than the second frequency f2 is high and the second integrated value a2 obtained by integrating the levels of the sound signals of the low frequency band f (L1 to L2) is low, the voice coil less frequently vibrates with a large amplitude in the low frequency band, and the cooling effect for the voice coil cannot be expected sufficiently. Accordingly, the speaker drive signal of a super high-frequency band exceeding 20 kHz is attenuated. Alternatively, the speaker drive signal of a super high-frequency band exceeding 20 kHz is blocked.

In the control unit 7, the first integrated value a1 and the second integrated value a2 may be compared; for example, the ratio of the first integrated value a1 (a1/(a1+a2)) may be calculated. When this ratio exceeds a predetermined threshold value, the variable filter 8 may be changed to a narrow band to attenuate or block a speaker drive signal of a super high-frequency band exceeding 20 kHz.

Alternatively, the ratio of the second integrated value a2 (a2/(a1+a2)) may be calculated, and when this ratio is equal to or less than a predetermined threshold value, the variable filter 8 may be changed to the narrow band.

To set the variable filter 8 to the narrow band in ST3, a signal having a frequency equal to or higher than 20 kHz exceeding the audible band may be blocked, or the attenuation rate of a signal having a frequency equal to or higher than 20 kHz exceeding the audible band may be changed in accordance with the level or the above ratio of the first integrated value a1. Alternatively, the wide passing frequency band in the variable filter 8 may be changed within the range of 20 kHz to 40 kHz in accordance with the level or the above ratio of the first integrated value a1.

When the audio control device 1 is used, even if the level of a sound signal equal to or higher than the first frequency f1 and the level of a sound signal equal to or lower than the second frequency f2 are high, it is possible to prevent heating of the voice coil and to suppress the temperature rise thereof as long as the integrated value of the levels of sound signals of the low frequency band f (L1 to L2) is high. In this case, therefore, the speaker drive signal Sr of a high frequency band equal to or higher than 20 kHz can be applied to the power amplifier 10, making it possible to create sound including the high-frequency sound signal.

In the audio control device 1 shown in FIG. 1, when it is determined that the value of the first integrated value a1 is high, a control signal is applied to the volume/tone adjustment unit 3 and a sound signal is subjected to the tone adjustment, that is, adjustment for lowering the level of a high-frequency component, with or without the adjustment of the variable filter 8.

Modifications of the embodiment of the present invention will be described below.

(First Modification)

In the block diagram shown in FIG. 1, the first fixed filter 4 may extract only the sound signals having a frequency equal to or higher than 20 kHz, which is the first frequency, and apply the sound signals to the level integrator 6, which then calculates the first integrated value a1 by integrating the levels of the sound signals having a frequency equal to or higher than 20 kHz. In this case, it is preferable to remove the sound signals having a frequency lower than 20 kHz with a low-pass filter before such signals are input to the sound source input unit 2.

(Second Modification)

In the block diagram shown in FIG. 1, without providing the second fixed filter 5, the level integrator 6 may obtain the first integrated value a1 by integrating the levels of the sound signals having a frequency equal to or higher than the first frequency f1, or may obtain the first integrated value a1 taking into account the level integrated value of a frequency equal to or lower than the second frequency f2, and the control unit 7 may use only the value of the first integrated value a1 (not using the second integrated value a2) to control the variable filter 8.

For example, even if the level of a sound signal in a high frequency range exceeding 20 kHz is temporarily high, the voice coil is not damaged at all as long as the high level does not continue for a long time but appears only occasionally. Therefore, when the value of the first integrated value a1 obtained by integrating the levels of the sound signals having a frequency equal to or higher than the first frequency f1 is low, it becomes possible to reproduce sound that reflects the originality of the sound source by applying the signals to the speaker 11, even if the level of the sound signal in a high frequency range is high.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An audio control device that generates a speaker drive signal by processing a sound signal from a sound source input unit, the audio control device comprising:

a first fixed filter that allows a sound signal in a frequency band higher than a first frequency to pass therethrough;

a second fixed filter that allows a sound signal in a low frequency band defined in a predetermined range within a frequency band lower than the first frequency to pass therethrough;

a level integrator that obtains a first integrated value by integrating levels of sound signals that have passed through the first fixed filter and obtains a second integrated value by integrating levels of sound signals in the low frequency band; and a control unit, wherein the control unit limits a sound signal in a frequency band higher than at least the first frequency when the first integrated value exceeds a predetermined value, and the control unit does not limit the sound signal in the frequency band higher than the first frequency when the first integrated value does not exceed the predetermined value, but the control unit avoids limiting a frequency band higher than the first frequency when the second integrated value is larger than a threshold value.

2. The audio control device according to claim 1, wherein a sound signal in a frequency band lower than a second frequency (the second frequency<the first frequency) is allowed to pass through the first fixed filter or another fixed filter connected to the first fixed filter, and the level integrator obtains the first integrated value by integrating the levels of sound signals in a frequency band higher than the first frequency and the levels of sound signals in a frequency band lower than the second frequency.

3. The audio control device according to claim 2, wherein: the frequency band lower than the first frequency is higher than the second frequency.

4. The audio control device according to claim 1, wherein the control unit limits a frequency band higher than at least the first frequency when the first integrated value exceeds a predetermined value and the second integrated value is lower than a predetermined value.

5. The audio control device according to claim 1, further comprising:

a frequency varying unit that varies a frequency distribution of the speaker drive signals, wherein the control unit controls the frequency varying unit to limit a frequency band higher than the first frequency among the speaker drive signals.

6. The audio control device according to claim 1, wherein the first frequency is set to any value within a range of 18 to 28 kHz.

7. The audio control device according to claim 2, wherein the second frequency is set to any value within a range of 5 to 50 Hz.

8. The audio control device according to claim 1, wherein the low frequency band is defined within a range of 20 Hz to 500 Hz.

9. The audio control device according to claim 1, wherein the control unit performs tone adjustment using an integrated value from the level integrator.

10. An audio control method that generates a speaker drive signal by processing a sound signal from a sound source input unit, the audio control method comprising:

using a first fixed filter, allowing a sound signal in a frequency band higher than a first frequency to pass therethrough;

using a second fixed filter, allowing a sound signal in a low frequency band defined in a predetermined range within a frequency band lower than the first frequency to pass therethrough, using a level integrator, obtaining a first integrated value by integrating levels of sound signals that have passed through the first fixed filter and obtaining a second integrated value by integrating levels of sound signals in the low frequency band; and using a control unit, limiting a sound signal in a frequency band higher than at least the first frequency when the first integrated value exceeds a predetermined value, and not limiting the sound signal in the frequency band higher than the first frequency when the first integrated value does not exceed the predetermined value, but the control unit avoids limiting a frequency band higher than the first frequency when the second integrated value is larger than a threshold value.

11. The audio control method according to claim 10, wherein a sound signal in a frequency band lower than a second frequency (the second frequency<the first frequency) is allowed to pass through the first fixed filter or another fixed filter connected to the first fixed filter, and the level integrator obtains the first integrated value by integrating the levels of sound signals in a frequency band higher than the first frequency and the levels of sound signals in a frequency band lower than the second frequency.

12. The audio control method according to claim 11, wherein:

the frequency band lower than the first frequency is higher than the second frequency.

13. The audio control method according to claim 10, wherein the control unit limits a frequency band higher than at least the first frequency when the first integrated value exceeds a predetermined value and the second integrated value is lower than a predetermined value.

14. The audio control method according to claim 10, further comprising:

using a frequency varying unit, varying a frequency distribution of the speaker drive signals, wherein the control unit controls the frequency varying unit to limit a frequency band higher than the first frequency among the speaker drive signals.

15. The audio control method according to claim 10, wherein the first frequency is set to any value within a range of 18 to 28 kHz.

16. The audio control method according to claim 11, wherein the second frequency is set to any value within a range of 5 to 50 Hz.

17. The audio control method according to claim 10, wherein the low frequency band is defined within a range of 20 Hz to 500 Hz.

18. The audio control method according to claim 10, wherein the control unit performs tone adjustment using an integrated value from the level integrator.

* * * * *